US007299649B2

(12) United States Patent
Healy et al.

(10) Patent No.: US 7,299,649 B2
(45) Date of Patent: Nov. 27, 2007

(54) VAPOR INJECTION SYSTEM

(75) Inventors: John J. Healy, Discovery Bay (HK); Man Wai Wu, Tseung Kwan O (HK); Simon Yiren Wang, Jardines Lookout (HK)

(73) Assignee: Emerson Climate Technologies, Inc., Sidney, OH (US)

( * ) Notice: Subject to any disclaimer, the term of this patent is extended or adjusted under 35 U.S.C. 154(b) by 482 days.

(21) Appl. No.: 10/875,064

(22) Filed: Jun. 23, 2004

(65) Prior Publication Data

US 2005/0120733 A1 Jun. 9, 2005

Related U.S. Application Data

(60) Provisional application No. 60/528,157, filed on Dec. 9, 2003.

(51) Int. Cl.
*F25B 13/00* (2006.01)

(52) U.S. Cl. ..... 62/324.4

(58) Field of Classification Search ..... 62/324.4, 62/324.1, 149, 219, 220
See application file for complete search history.

(56) References Cited

U.S. PATENT DOCUMENTS

| | | | | |
|---|---|---|---|---|
| 3,589,140 | A | | 6/1971 | Osborne |
| 3,864,934 | A | | 2/1975 | Jeding et al. |
| 3,871,187 | A | | 3/1975 | Skvarenina |
| 4,033,738 | A | | 7/1977 | Merola et al. |
| 4,059,968 | A | | 11/1977 | Ross |
| 4,369,633 | A | | 1/1983 | Snyder |
| 4,370,868 | A | | 2/1983 | Kim et al. |
| 4,439,114 | A | | 3/1984 | Kimmell |
| 4,466,253 | A | | 8/1984 | Jaster |
| 4,475,354 | A | | 10/1984 | Akerhielm et al. |
| 4,551,983 | A | * | 11/1985 | Atsumi et al. ..... 62/174 |
| 4,573,327 | A | | 3/1986 | Cochran |
| 4,665,716 | A | | 5/1987 | Cochran |
| 4,831,843 | A | | 5/1989 | Cochran |
| 5,069,043 | A | | 12/1991 | Wachs, III et al. |
| 5,113,668 | A | | 5/1992 | Wachs, III et al. |
| 5,189,885 | A | | 3/1993 | Ni |
| 5,255,529 | A | | 10/1993 | Powell et al. |
| 5,285,653 | A | | 2/1994 | Meloling et al. |
| 5,431,026 | A | | 7/1995 | Jaster |
| 5,475,986 | A | | 12/1995 | Bahel et al. |
| 5,515,694 | A | | 5/1996 | Meloling et al. |
| 5,605,051 | A | | 2/1997 | Iritani et al. |
| 5,687,578 | A | | 11/1997 | Cochran |

(Continued)

*Primary Examiner*—Melvin Jones
(74) *Attorney, Agent, or Firm*—Harness, Dickey * Pierce, P.L.C.

(57) ABSTRACT

A heat pump includes a first and second heat exchanger, a scroll compressor and a flash tank in fluid communication. The flash tank includes an inlet fluidly coupled to the heat exchangers to receive liquid refrigerant. Furthermore, the flash tank includes a first outlet fluidly coupled to the first and second heat exchangers and a second outlet fluidly coupled to the scroll compressor. The first outlet is operable to deliver sub-cooled-liquid refrigerant to the heat exchangers while the second outlet is operable to deliver vaporized refrigerant to the scroll compressor. An expansion valve is further provided and is operable to selectively open and close the inlet by a float device. The float device is operable to control an amount of liquid refrigerant disposed within the flash tank by regulating an amount of liquid refrigerant entering the flash tank via the inlet.

65 Claims, 11 Drawing Sheets

U.S. PATENT DOCUMENTS 5,692,389 A 12/1997 Lord et al.
5,724,821 A 3/1998 Lord et al.
5,778,695 A 7/1998 Ring et al.
5,806,327 A 9/1998 Lord et al.
5,829,265 A 11/1998 Lord et al.
5,848,537 A 12/1998 Biancardi et al.
6,015,453 A 1/2000 Haugen et al.
6,018,958 A 2/2000 Lingelbach et al.
6,047,557 A 4/2000 Pham et al.
6,070,420 A * 6/2000 Biancardi et al. ..... 62/114
6,122,931 A 9/2000 Paganessi et al.
6,213,731 B1 4/2001 Doepker et al.
6,233,962 B1 5/2001 Scherer et al.
6,385,980 B1 5/2002 Sienel
6,434,956 B1 8/2002 Ota et al.
6,474,087 B1 11/2002 Lifson
6,499,305 B2 12/2002 Pham et al.
6,530,238 B2 3/2003 Hansen
6,601,397 B2 8/2003 Pham et al.
6,619,936 B2 9/2003 Perevozchikov
6,672,090 B1 1/2004 Healy et al.
6,745,584 B2 6/2004 Pham et al.
6,931,867 B2 8/2005 Healy et al.
2005/0103487 A1* 5/2005 Aflekt et al. ..... 165/202
2005/0120733 A1 6/2005 Healy et al.

* cited by examiner

VAPOR INJECTION SYSTEM

CROSS-REFERENCE TO RELATED APPLICATIONS

This application claims the benefit of U.S. Provisional Application No. 60/528,157, filed on Dec. 9, 2003. The disclosure of the above application is incorporated herein by reference.

FIELD OF THE INVENTION

The present invention relates to vapor injection and, more particularly, to a heating or cooling system having an improved vapor injection system.

DISCUSSION OF THE INVENTION

Heating and/or cooling systems including air-conditioning, chiller, refrigeration and heat pump systems may include a flash tank disposed between a heat exchanger and the compressor for use in improving system capacity and efficiency. The flash tank is operable to receive a stream of liquid refrigerant from a heat exchanger and convert a portion of the liquid refrigerant into vapor for use by the compressor. Because the flash tank is held at a lower pressure relative to the inlet liquid refrigerant, some of the liquid refrigerant vaporizes, causing the remaining liquid refrigerant in the flash tank to lose heat and become sub-cooled and increasing the pressure of the vaporized refrigerant in the flash tank. Flash tanks contain both vaporized refrigerant and sub-cooled-liquid refrigerant.

The vaporized refrigerant from the flash tank is distributed to a medium or intermediate pressure input of the compressor, whereby the vaporized refrigerant is at a substantially higher pressure than vaporized refrigerant leaving the evaporator, but at a lower pressure than an exit stream of refrigerant leaving the compressor. The pressurized refrigerant from the flash tank allows the compressor to compress this pressurized refrigerant to its normal output pressure while passing it through only a portion of the compressor.

The sub-cooled refrigerant disposed in the flash tank is operable to increase the capacity and efficiency of the heat exchanger. Specifically, the sub-cooled liquid is discharged from the flash tank and is sent to one of the heat exchangers depending on the desired mode (i.e., heating or cooling). Because the liquid is in a sub-cooled state, more heat can be absorbed from the surroundings by the heat exchanger. In this manner, the overall performance of the heating or cooling cycle is improved.

The flow of pressurized refrigerant from the flash tank to the compressor is regulated to ensure that only vaporized refrigerant is received by the compressor. Similarly, flow of sub-cooled-liquid refrigerant from the flash tank to the heat exchanger is regulated to inhibit flow of vaporized refrigerant from the flash tank to the heat exchanger. Both of the foregoing situations may be controlled by regulating the flow of liquid refrigerant into the flash tank. In other words, by regulating the flow of liquid refrigerant into the flash tank, the amount of vaporized refrigerant and sub-cooled-liquid refrigerant may be controlled, thereby controlling flow of vaporized refrigerant to the compressor and sub-cooled-liquid refrigerant to the heat exchanger.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
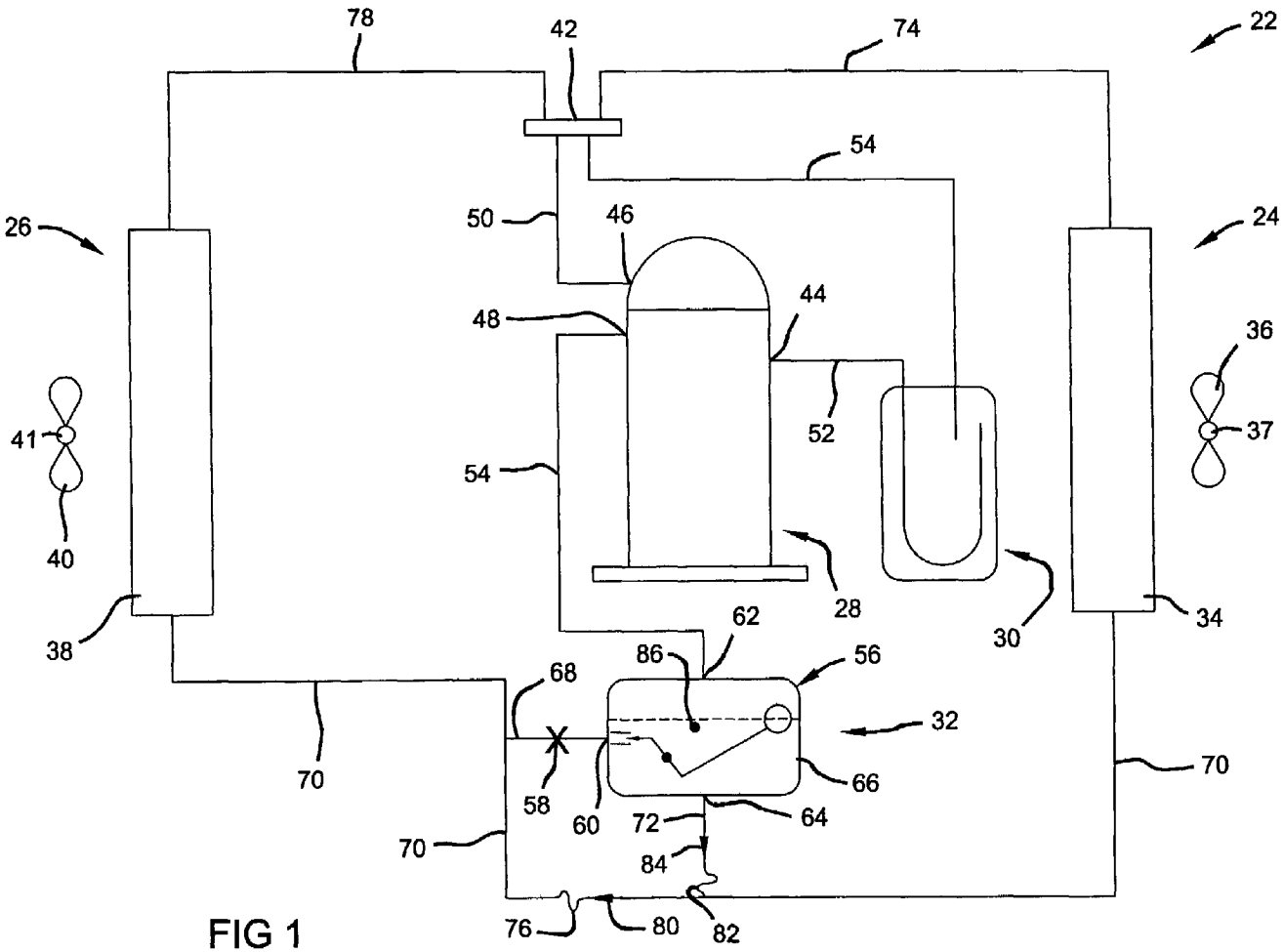
FIG. 1 is a schematic view of a heat pump system in accordance with the principles of the present invention.

The following description of the preferred embodiment(s) is merely exemplary in nature and is in no way intended to limit the invention, its application, or uses.

Vapor injection may be used in air-conditioning, chiller, refrigeration and heat pump systems to improve system capacity and efficiency. Vapor injection systems may include a flash tank for vaporizing refrigerant supplied to a compressor and sub-cooling refrigerant supplied to a heat exchanger. Vapor injection may be used in heat pump systems, which are capable of providing both heating and cooling to commercial and residential buildings, to improve one or both of heating and cooling capacity and efficiency. For the same reasons, flash tanks may be used in chiller applications to provide a cooling effect for water, in refrigeration systems to cool an interior space of a display case or refrigerator, and in air-conditioning systems to effect the temperature of a room or building. While heat pump systems may include a cooling cycle and a heating cycle, chiller, refrigeration and air-conditioning systems often only include a cooling cycle. However, heat pump chillers which provide a heating and cooling cycle are the norm in some parts of the world. Each system uses a refrigerant to generate the desired cooling or heating effect through a refrigeration cycle.

For air-conditioning applications, the refrigeration cycle is used to lower the temperature of the new space to be cooled, typically a room or building. For this application, a fan or blower is typically used to force the ambient air into more rapid contact with the evaporator to increase heat transfer and cool the surroundings.

For chiller applications, the refrigeration cycle cools or chills a stream of water. Heat pump chillers use the refrigeration cycle to heat a stream of water when operating on HEAT mode. Rather than using a fan or blower, the refrigerant remains on one side of the heat exchanger while circulating water or brine provides the heat source for evaporation. Heat pump chillers often use ambient air as the heat source for evaporation during HEAT mode but may also use other sources such as ground water or a heat exchanger that absorbs heat from the earth. Thus, the heat exchanger cools or heats the water passing therethrough as heat is transferred from the water into the refrigerant on COOL mode and from the refrigerant into the water on HEAT mode.

In a refrigeration system, such as a refrigerator or refrigerated display case, the heat exchanger cools an interior space of the device and a condenser rejects the absorbed heat. A fan or blower is often used to force the air in the interior space of the device into more rapid contact with the evaporator to increase heat transfer and cool the interior space.

In a heat pump system, the refrigeration cycle is used to both heat and cool. A heat pump system may include an indoor unit and an outdoor unit, and the indoor unit is operable to both heat and cool a room or an interior space of a commercial or residential building. The heat pump may also be of a monobloc construction with the "outdoor" and "indoor" parts combined in one frame.

As described previously, the refrigeration cycle is applicable to air conditioning, chiller, heat pump chiller, refrigeration and heat pump systems. While each system has unique features, vapor injection may be used to improve system capacity and efficiency. That is, in each system, a flash tank receiving a stream of liquid refrigerant from a heat exchanger and converting a portion of the liquid refrigerant into vapor, may be supplied to a medium or intermediate pressure input of the compressor, whereby the vaporized refrigerant is at a higher pressure than vaporized refrigerant leaving the evaporator, but at a lower pressure than an exit stream of refrigerant leaving the compressor. The pressurized refrigerant from the flash tank, therefore, allows the compressor to compress this pressurized refrigerant to its normal output pressure while passing it through only a portion of the compressor. Further, the sub-cooled refrigerant in the flash tank is useful to increase the capacity and efficiency of the heat exchanger. Because the liquid discharged from the flash tank is sub-cooled, when supplied to the heat exchanger, more heat can be absorbed from the surroundings, increasing overall performance of the heating or cooling cycle. More specific examples will be provided next with reference to the drawings, but one of skill in the art should recognize that while the examples described in this application include air conditioning, the teachings are applicable to other systems and certain features described with respect to a particular type of system may be equally applicable to other types of systems.

In the following paragraphs, heat pump systems with vapor injection according to the teachings will be particularly described, followed by cooling systems with vapor injection according to the invention. The latter description is more specifically suited to air-conditioning, chiller and refrigeration systems.

With reference to FIGS. 1-7, a heat pump system 22 is provided and includes an outdoor unit 24, an indoor unit 26, a scroll compressor 28, an accumulator tank 30, and a vapor injection system 32. The indoor and outdoor units 24, 26 are in fluid communication with the scroll compressor 28, accumulator tank 30, and vapor injection system 32 such that a refrigerant may circulate therebetween. The refrigerant cycles through the system 22 under pressure from the scroll compressor 28 and circulates between the indoor and outdoor units 24, 26 to reject and absorb heat. As can be appreciated, whether the indoor or outdoor unit 24, 26 rejects or accepts heat will depend on whether the heat pump system 22 is set to COOL or HEAT, as will be discussed further below.

The outdoor unit 24 includes an outdoor coil or heat exchanger 34 and an outdoor fan 36 driven by a motor 37. The outdoor unit 24 includes a protective housing that encases the outdoor coil 34 and outdoor fan 36 so that the fan 36 will draw ambient outdoor air across the outdoor coil 34 to improve heat transfer. In addition, the outdoor unit 24 usually houses the scroll compressor 28 and accumulator tank 30. While outdoor unit 24 has been described as including a fan 36 to draw ambient air across the coil 34, it should be understood that any method of transferring heat from the coil 34, such as burying the coil 34 below ground or passing a stream of water around the coil 34, is considered within the scope of the present invention.

The indoor unit 26 includes an indoor coil or heat exchanger 38 and an indoor fan 40 driven by a motor 41, which may be a single-speed, two-speed, or variable-speed motor. The indoor fan 40 and coil 38 are enclosed in a cabinet so that the fan 40 forces ambient indoor air across the indoor coil 38 at a rate determined by the speed of the variable speed motor. As can be appreciated, such air flow across the coil 38 causes heat transfer between the ambient indoor surroundings and the indoor coil 38. In this regard, the indoor coil 38, in conjunction with the indoor fan 40, is operable to selectively raise or lower the temperature of the indoor surroundings. Again, while a fan 40 is disclosed, it should be understood that in a chiller application, heat is transferred from a stream of water directly to the refrigerant and, as such, may obviate the need for the fan 40.

The heat pump system 22 is designated for both cooling and heating by simply reversing the function of the indoor coil 38 and the outdoor coil 34 via a four-way reversing valve 42. Specifically, when the four-way valve 42 is set to the COOL position, the indoor coil 38 functions as an evaporator coil and the outdoor coil 34 functions as a condenser coil. Conversely, when the four-way valve 42 is switched to the HEAT position (the alternate position), the function of the coils 34, 38 is reversed, i.e., the indoor coil 38 functions as the condenser and the outdoor coil 34 functions as the evaporator. When the indoor coil 38 acts as an evaporator, heat from the ambient-indoor indoor surroundings is absorbed by the liquid refrigerant moving through the indoor coil 38. Such heat transfer between the indoor coil 38 and the liquid refrigerant cools the surrounding indoor air. Conversely, when the indoor coil 38 acts as a condenser, heat from the vaporized refrigerant is rejected by the indoor coil 38, thereby heating the surrounding indoor air.

The scroll compressor 28 is housed within the outdoor unit 24 and is operable to pressurize the heat pump system 22 such that refrigerant is circulated throughout the system 22. The scroll compressor 28 includes a suction side having a suction port 44, a discharge port 46, and a vapor injection port 48. The discharge port 46 is fluidly connected to the four-way valve 42 by a conduit 50 such that a pressurized stream of refrigerant may be distributed to the outdoor and indoor units 24, 26 via four-way valve 42. The suction port 44 is fluidly coupled to the accumulator tank 30 via conduit 52 such that the scroll compressor 28 draws a stream of refrigerant from the accumulator tank 30 for compression.

The scroll compressor 28 receives refrigerant at the suction port 44 from the accumulator tank 30, which is fluidly connected to the four-way valve 42 via conduit 54 and operable to receive a flow of refrigerant from the outdoor and indoor units 24, 26 for compression by the scroll compressor 28. The accumulator tank 30 serves to store low-pressure refrigerant received from the outdoor and indoor units 24, 26 and to protect the compressor 28 from the possibility of refrigerant returning in a liquid state prior to compression.

The vapor injection port 48 is fluidly coupled to the vapor injection system 32 via conduit 54, which may include a solenoid valve (not shown), and receives a flow of pressurized refrigerant from the vapor injection system 32. Specifically, the vapor injection system 32 produces a stream of pressurized vapor at a higher-pressure level than that supplied by the accumulator tank 30, but at a lower pressure than produced by the scroll compressor 28. After the pressurized vapor reaches a heightened pressure level, the vapor injection system 32 delivers the pressurized refrigerant to the scroll compressor 28 via vapor injection port 48. By delivering pressurized-vapor refrigerant to the scroll compressor 28, heating and cooling capacity and efficiency of the system 22 may be improved. As can be appreciated, such an increase in efficiency may be even more pronounced when the difference between the outdoor temperature and the desired indoor temperature is relatively large (i.e., during hot or cold weather).

With reference to FIGS 1 and 9-11, the vapor injection system 32 is shown to include a flash tank 56 and a solenoid valve 58. The flash tank 56 includes an inlet port 60, a vapor outlet 62, and a sub-cooled-liquid outlet 64, each fluidly coupled to an interior volume 66. The inlet port 60 is fluidly coupled to the outdoor and indoor units 24, 26 via conduits 68, 70, as best shown in FIG. 1. The vapor outlet (port) 62 is fluidly coupled to the vapor injection port 48 of the scroll compressor 28 via conduit 54 while the sub-cooled-liquid outlet port 64 is fluidly coupled to the outdoor and indoor units 24, 26 via conduits 72, 70.

When the heat pump system 22 is set to COOL, the scroll compressor 28 imparts a suction force on the accumulator tank 30 to thereby draw a stream of vaporized refrigerant into the scroll compressor 28. Once the vapor is sufficiently pressurized, the high-pressure refrigerant is discharged from the scroll compressor 28 via discharge port 46 and conduit 50. The four-way valve 42 directs the pressurized refrigerant to the outdoor unit 24 via conduit 74. Upon reaching the outdoor coil 34, the refrigerant releases stored heat due to the interaction between the outside air, the coil 34, and the pressure imparted by the scroll compressor 28. As can be appreciated, after the refrigerant has released a sufficient amount of heat, the refrigerant will change phase from a gaseous or vaporized phase to a liquid phase.

After the refrigerant has changed phase from gas to liquid, the refrigerant will move from the outdoor coil 34 to the indoor coil 38 via conduit 70. An expansion device 76 disposed between the outdoor unit 24 and the indoor unit 26 serves to lower the pressure of the liquid refrigerant. The expansion device 76 may be a capillary tube that acts to expand the liquid refrigerant due to the interaction between the moving liquid refrigerant and inner walls of the capillary tube 76. In this manner, the liquid refrigerant is expanded prior to reaching the indoor unit 26 and begins to transition back to the gaseous phase. It should be noted that when the system 22 is set to COOL, the solenoid valve 58 is typically closed such that flow is restricted from entering the flash tank 56.

Upon reaching the indoor unit 26, the liquid refrigerant will enter the indoor coil 38 to complete the transition from the liquid phase to the gaseous phase. The liquid refrigerant enters the indoor coil 38 at a low pressure (due to the interaction of the capillary tube 76, as previously discussed) and is operable to absorb heat from the surroundings. As the fan 40 passes air through the coil 38, the refrigerant absorbs the heat and completes the phase change, thereby cooling the air passing through the indoor coil 38 and, thus, cooling the surroundings. Once the refrigerant reaches the end of the indoor coil 38, the refrigerant is in a low-pressure gaseous state. At this point, the suction from the scroll compressor 28 causes the refrigerant to return to the accumulator tank 30 via conduit 78 and four-way valve 42.

When the heat pump system 22 is set to HEAT, the scroll compressor 28 imparts a suction force on the accumulator tank 30 to thereby draw a stream of vaporized refrigerant into the scroll compressor 28. Once the vapor is sufficiently pressurized, the high-pressure refrigerant is discharged from the scroll compressor 28 via discharge port 46 and conduit 50. The four-way valve 42 directs the pressurized refrigerant to the indoor unit 26 via conduit 78. Upon reaching the indoor coil 38, the refrigerant releases stored heat due to the interaction between the inside air, the coil 38, and the pressure imparted by the scroll compressor 28 and, as such, heats the surrounding area. As can be appreciated, once the refrigerant has released a sufficient amount of heat, the refrigerant will change phase from the gaseous or vaporized phase to a liquid phase.

Once the refrigerant has changed phase from gas to liquid, the refrigerant will move from the indoor coil 38 to the outdoor coil 34 via conduits 70 and 68. More particularly, the liquid refrigerant first travels along conduit 70 until reaching a check valve 80. The check valve 80 restricts further movement of the liquid refrigerant along conduit 70 from the indoor coil 26 to the outdoor coil 24. In doing so, the check valve 80 causes the liquid refrigerant to flow into conduit 68 and encounter the solenoid valve 58.

The solenoid valve 58 is toggled into an open position when the four-way valve 42 is set to the HEAT position to allow the flow of liquid refrigerant to reach the outdoor unit 24 via the vapor injection system 32. As the solenoid valve 58 is in the open position, the liquid refrigerant is permitted to enter the flash tank 56 via inlet port 60. As the liquid refrigerant flows through the inlet port 60, the interior volume 66 of the flash tank 56 begins to fill. The entering liquid refrigerant causes the fixed interior volume 66 to become pressurized as the volume of the tank is filled. The solenoid valve 58 is operable to be selectively opened and closed when the system is set to either HEAT or COOL to selectively restrict and permit refrigerant from entering the flash tank 56. Opening and closing of the solenoid valve 58 is largely dependent upon system conditions and compressor requirements, as will be discussed further below.

Once the liquid refrigerant reaches the flash tank 56, the liquid releases heat, thereby causing some of the liquid refrigerant to vaporize and some of the liquid to enter a sub-cooled-liquid state. At this point, the flash tank 56 has a mixture of both vaporized refrigerant and sub-cooled-liquid refrigerant, whereby the vaporized refrigerant is at a higher pressure than that of the vaporized refrigerant leaving the coils 34, 38 but at a lower pressure than the vaporized refrigerant leaving the discharge port 46 of the scroll compressor 28.

The vaporized refrigerant exits the flash tank 56 via the vapor outlet (port) 62 and is fed into the vapor injection port 48 of the scroll compressor 28. The pressurized vapor-refrigerant allows the scroll compressor 28 to deliver an outlet refrigerant stream with a desired output pressure, thereby improving the overall efficiency of the system 22, as previously discussed.

The sub-cooled-liquid refrigerant exits the flash tank 56 via port 64 and reaches the outdoor unit 24 via conduits 72, 70. The sub-cooled-liquid refrigerant leaves port 64 and encounters an expansion device 82 such as a capillary tube, which is adapted to expand the liquid refrigerant prior to reaching the outdoor coil 34 in an effort to improve the ability of the refrigerant to extract heat from the outside. Once the refrigerant absorbs heat from the outside via outdoor coil 34, the refrigerant will once again return to the gaseous stage and return to the accumulator tank 30 via conduit 74 and four-way valve 42 to begin the cycle again. System 22 further includes a check valve 84, which is generally disposed on conduit 72 between conduit 70 and sub-cooled-liquid port 64 and prevents refrigerant from entering the flash tank 56 via discharge port 64 when the refrigerant is moving through conduit 70 from either the outdoor or indoor units 24, 26.

Figure 9:
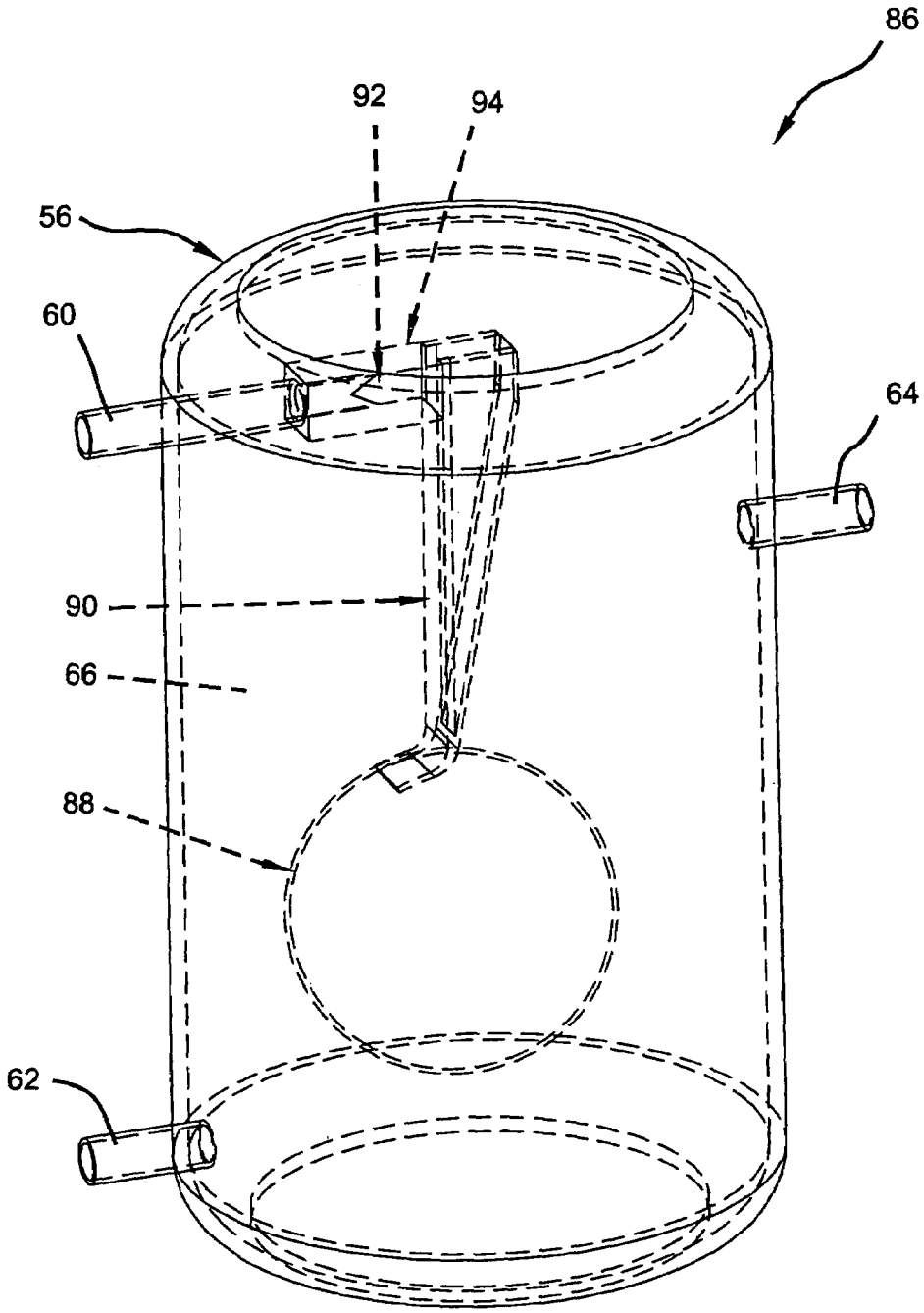
FIG. 9 is a perspective view of a flash tank in accordance with the principals of the present invention.
Figure 10:
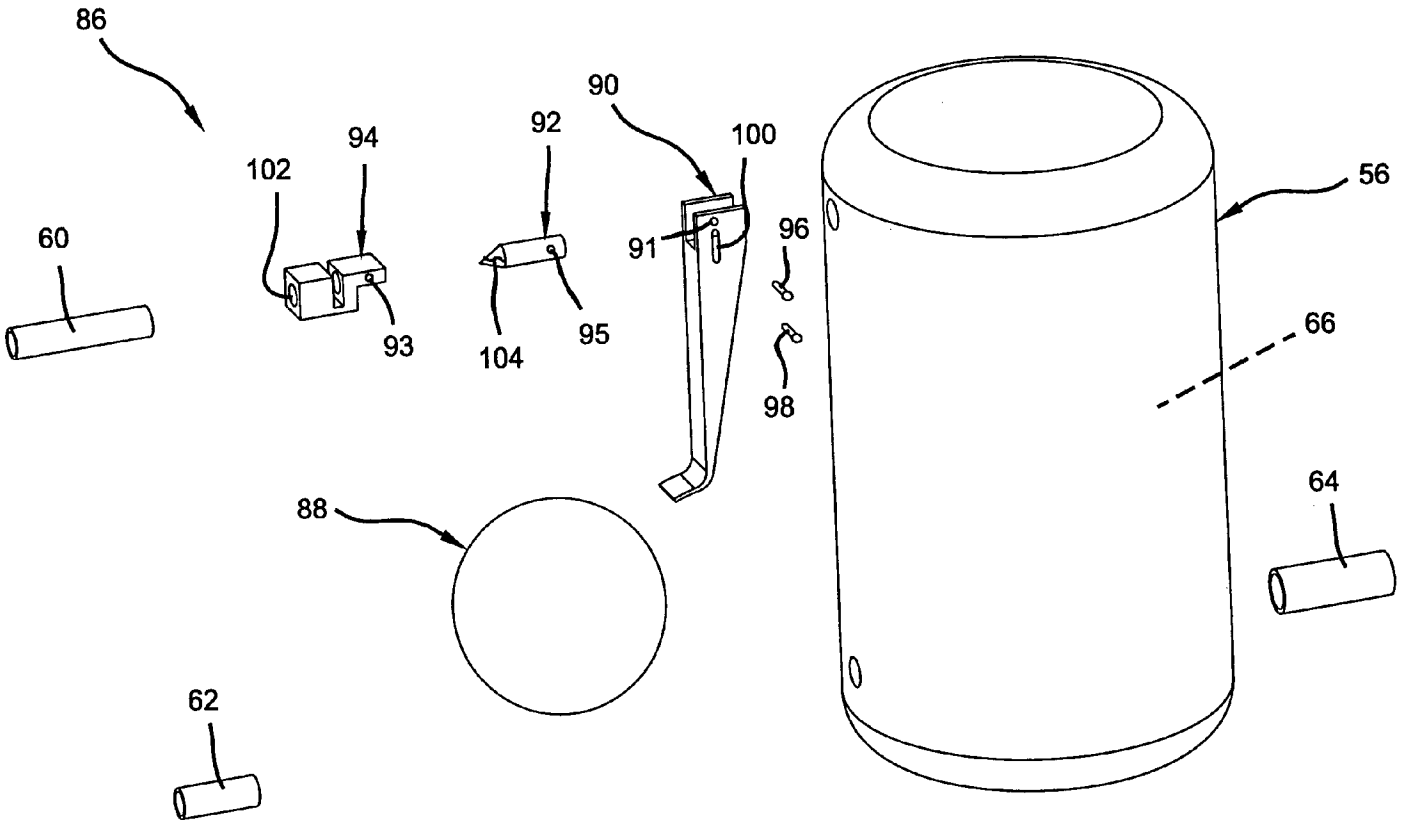
FIG. 10 is an exploded view of the flash tank of FIG. 9.
Figure 11:
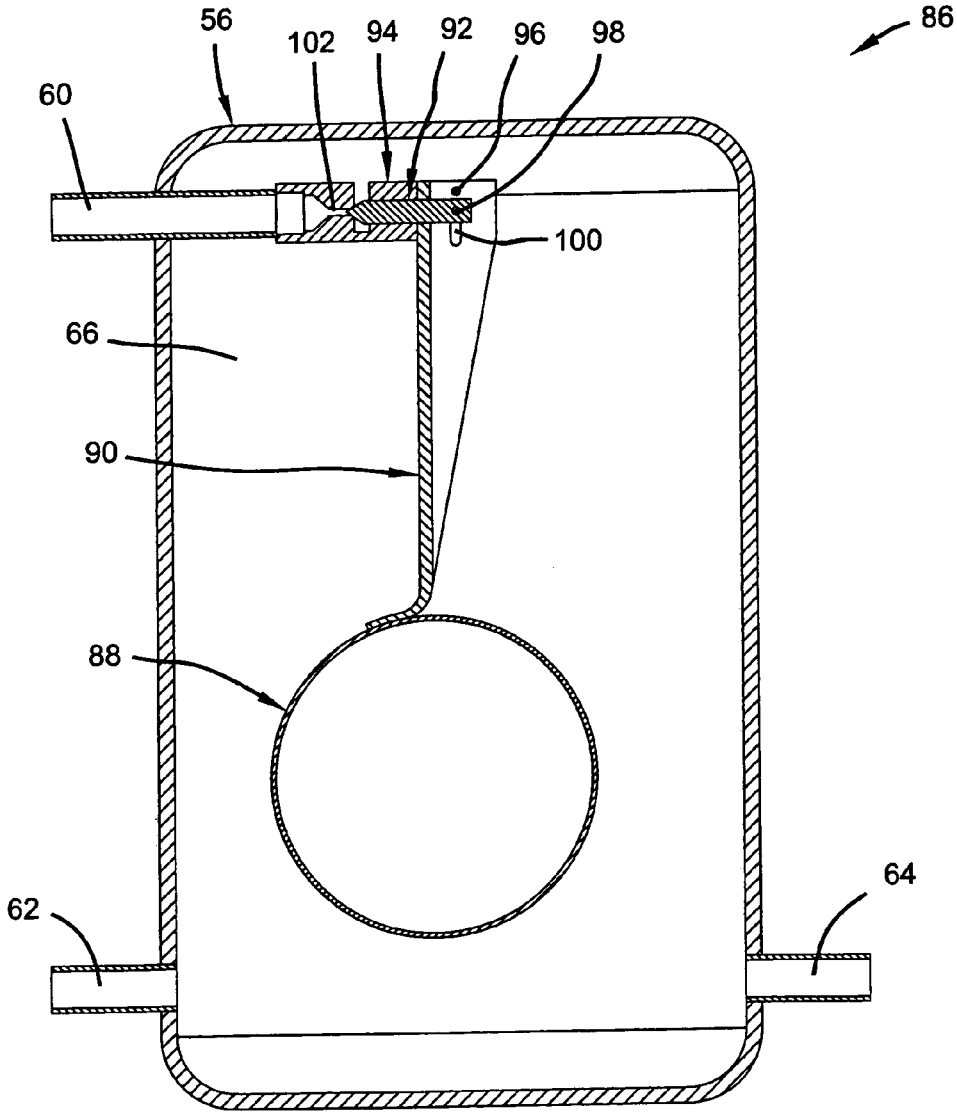
FIG. 11 is a cross-sectional view of the flash tank of FIG. 9.

With particular reference to FIGS. 9-11, an expansion device 86 is further provided to control the amount of vaporized refrigerant in the flash tank 56, and subsequently the amount of vaporized refrigerant reaching the vapor injection port 48 of the scroll compressor 28. The expansion device 86 includes a buoyant member 88, an outwardly extending arm 90, a needle 92, and a needle housing 94. The buoyant member 88 is fixedly attached to, and supported by, the outwardly extending arm 90, as best shown in FIG. 11. The buoyant member 88 is adapted to float on the liquid refrigerant disposed within the interior volume 66 of the flash tank 56, thereby indicating a liquid level of refrigerant in the flash tank 56.

The outwardly extending arm 90 is fixedly attached to the buoyant member 88 at a first end and pivotably supported by the needle housing 94 at a second end. In this manner, as the buoyant member 88 moves in an axial direction, due to changing levels of liquid refrigerant in the flash tank 56, the second end of the outwardly extending arm 90 will pivot relative to the needle housing 94. Such pivotal movement of the outwardly extending arm 90 causes concurrent movement of the needle 92 relative to the needle housing 94, due to the relationship between the needle 92 and the arm 90, as will be discussed further below.

The second end of the arm 90 is pivotably supported by the needle housing 92 by a pivot 96, whereby the pivot 96 is rotatably received through an aperture 91 of the arm 90 and fixedly attached to the housing 94 at an aperture 93. In this regard, movement of the buoyant member 88 rotates the arm 90 relative to the housing 94 about pivot 96. In addition, a pin 98 is fixedly attached to the needle 92 via aperture 95 and slidably received by a slot 100 of the arm 90 such that as the arm 90 rotates about pivot 96, the pin 98 translates within slot 100. Such movement of the pin 98 within slot 100 causes concurrent axial movement of the needle 92 relative to the needle housing 94 as the needle 92 is fixedly attached to the pin 98.

The needle 92 is slidably received by a bore 102 formed in the needle housing 94 such that movement of the pin 98 along slot 100 causes concurrent movement of the needle 92 within the bore 102. The needle 92 includes a tapered surface 104 adapted to selectively engage the inlet port 60 to selectively open and close the inlet 60. The tapered surface 104 engages the inlet 60 in a fully closed position and retracts from engagement with the inlet 60 allow liquid refrigerant to enter the flash tank 56.

The tapered surface 104 allows the needle 92 to provide a plurality of open positions depending on the position of the buoyant member 88 within the interior volume 66. For example, if the position of the buoyant member 88 is in a desired position (such that a desired amount of liquid refrigerant is disposed within the flash tank 56) the tapered surface 104 will engage the inlet 60 to restrict refrigerant from entering the flash tank 56. If there is insufficient liquid refrigerant disposed within the interior volume 66 of the flash tank 56, the buoyant member 88 will drop, thereby causing the arm 90 to pivot.

Pivotal movement of the arm 90 causes axial movement of the needle 92 relative to the needle housing 94 due to the interaction of the pin 98, slot 100, and needle 92, as previously discussed. Such movement of the needle 92 within bore 102 causes the tapered surface 104 to disengage the inlet 60 and allow liquid refrigerant to enter the flash tank 56. As can be appreciated, the more the buoyant member 88 drops, the more the arm 90 will move the needle 92 away from the inlet 60. As the needle 92 moves farther from the inlet 60, more liquid refrigerant is allowed to enter the flash tank 56 due to the tapered surface 104 which, as it moves away from the inlet 60, more liquid refrigerant is allowed to pass through the inlet 60 and around the tapered surface 104. In this manner, the needle 92 is operable to control the amount of liquid refrigerant within the flash tank 56 due to the relationship between the buoyant member 88, arm 90, and tapered surface 104.

The vapor injection system 32 is operable to control circulation of the refrigerant within the system 22 as movement of the refrigerant from the indoor unit 26 to the outdoor unit 24 is effectively controlled by the amount of vaporized refrigerant drawn into the vapor injection port 48 of the scroll compressor 28 and the amount of sub-cooled liquid flowing to the evaporator 34 via port 64. The vapor injection system 32 will only allow liquid refrigerant to enter the flash tank 56 when sufficient vapor has been extracted from the interior volume 66 and sufficient sub-cooled liquid has exited via port 64. Additional liquid refrigerant may be needed in the flash tank 56 to backfill vapor exiting through port 62 when the scroll compressor 28 has drawn vaporized refrigerant out of the flash tank 56 and sub-cooled-liquid refrigerant has discharged through port 64. In this manner, the vapor injection system 32 is operable to control refrigerant flow when the four-way valve 42 is in the HEAT position.

Figure 2:
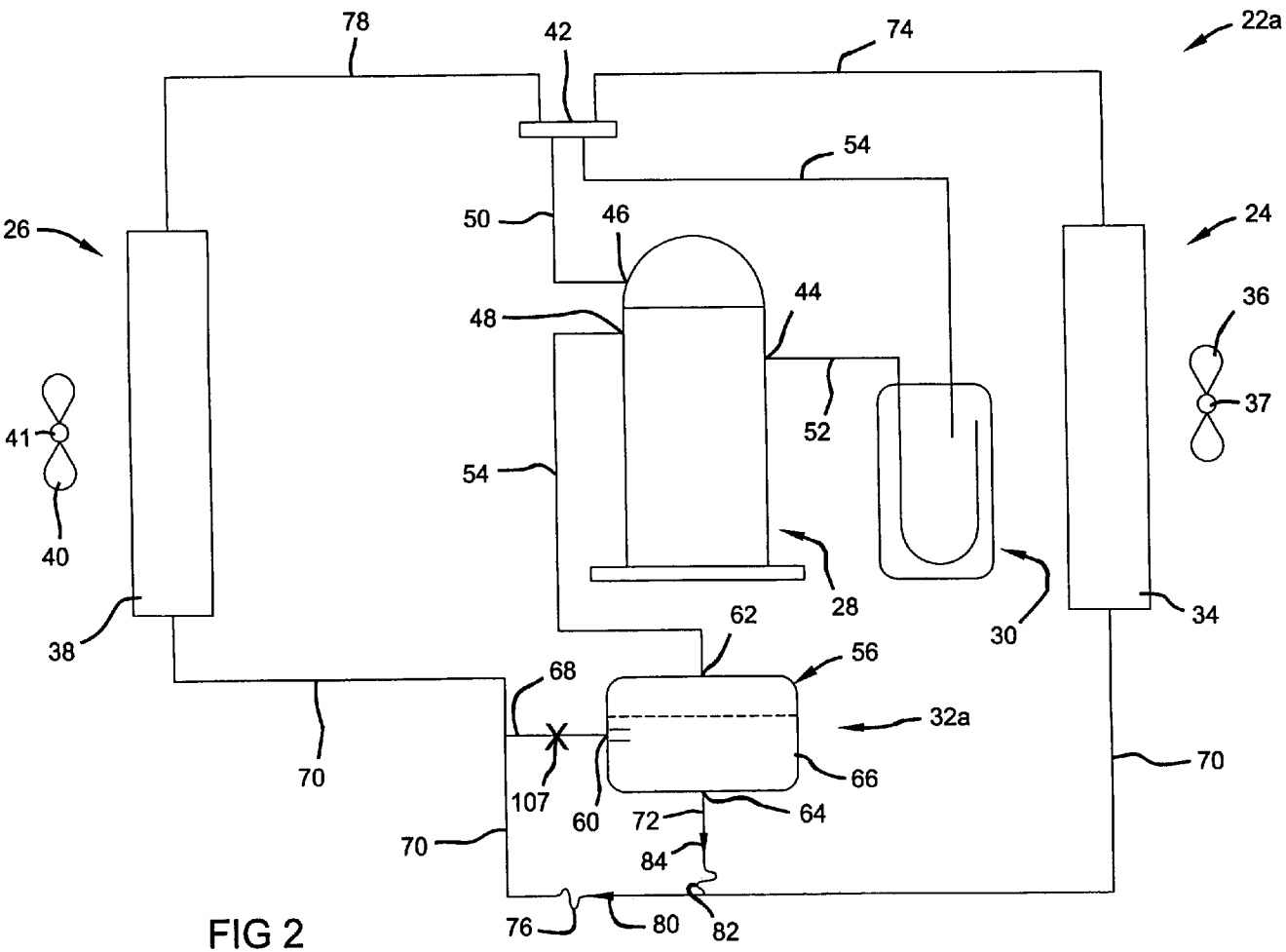
FIG. 2 is a schematic view of a heat pump system in accordance with the principles of the present invention.

With reference to FIG. 2, a heat pump system **22*a* is shown. In view of the similarity in structure and function of the components associated with the heat pump system 22** described above, like reference numerals are used hereinafter and in the drawings to identify like components while like reference numerals containing letter extensions are used to identify those components that have been modified.

The heat pump system **22*a* includes a vapor injection system 32*a*, which has an electronic expansion valve 107 in place of the solenoid valve 58. The system 22*a* functions similarly to the system described above with respect to refrigerant flow in both the COOL and HEAT modes. The electronic expansion valve 107 provides the system 22*a* with the ability to further control the flow of fluid refrigerant into the flash tank 56 by selectively restricting and permitting varying amounts of refrigerant into the flash tank 56 in response to sensed system parameters such as, but not limited to, liquid refrigerant reaching the scroll compressor 28 or refrigerant not fully condensing or evaporating in the coils 34, 38 (depending on the position of the four-way valve 42 in either HEAT or COOL). Any of the foregoing conditions may indicate that the system 22*a* is not operating at optimum efficiency. In this manner, the electronic expansion valve 107 is operable to control refrigerant flow into the flash tank 56 in an effort to balance refrigerant flow and optimize the capacity and efficiency of the system 22***a*. The expansion device 86 (see FIG. 1) may be rendered unnecessary by the electronic expansion valve 107.

Figure 3:
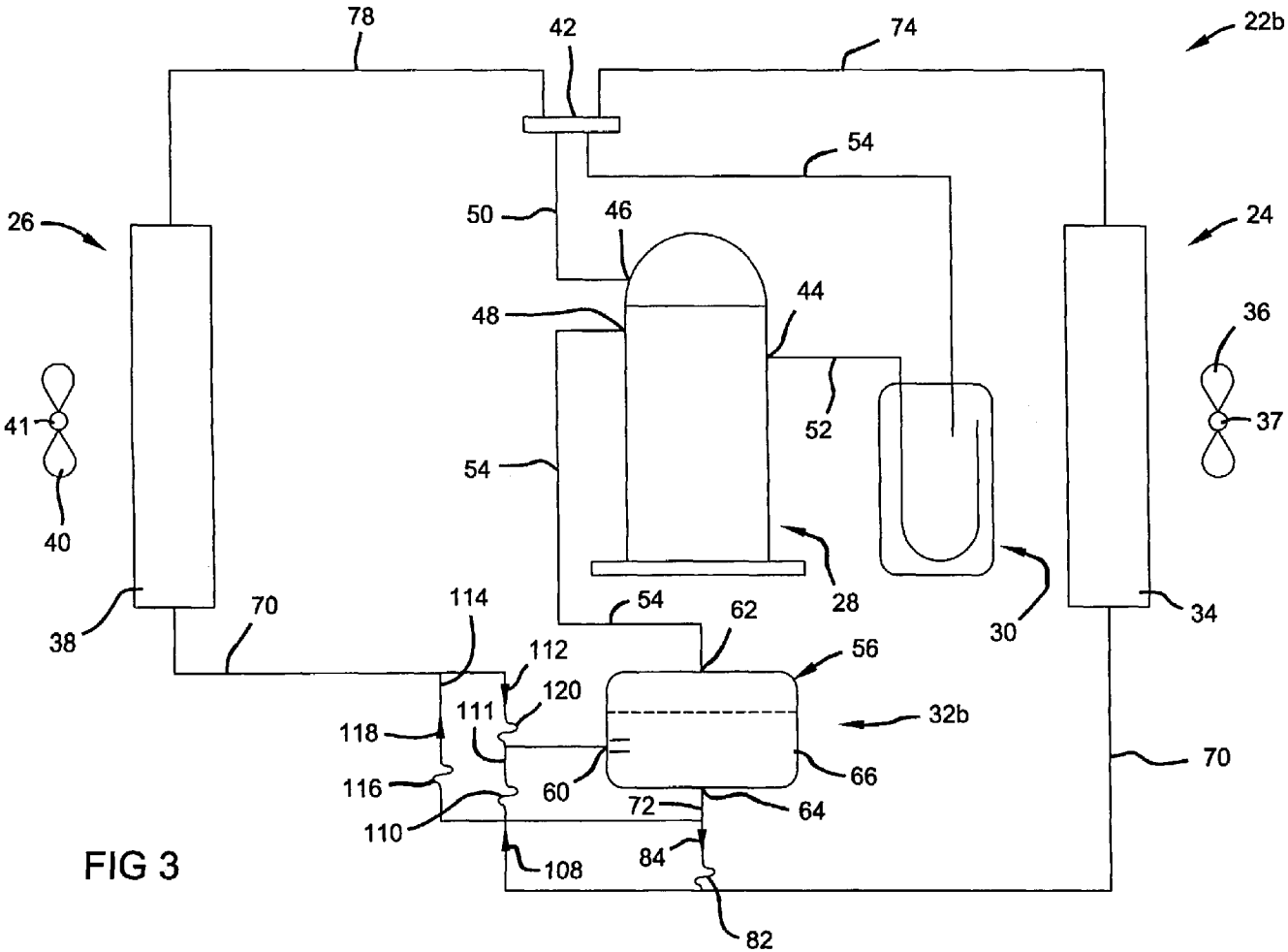
FIG. 3 is a schematic view of a heat pump system in accordance with the principles of the present invention.

With reference to FIG. 3, a heat pump system 22*b* is shown. In view of the similarity in structure and function of the components associated with the heat pump systems described above, like reference numerals are used hereinafter and in the drawings to identify like components while like reference numerals containing letter extensions are used to identify those components that have been modified.

The heat pump system 22*b* does not include a solenoid valve 58, electronic expansion valve 107, nor expansion device 86 to regulate flow into the flash tank 56. Rather, a pair of capillary tubes 110 and 120 control flow into the tank 56, while flow from the tank 56 to the heat exchangers 34, 38 is controlled by a pair of capillary tubes 82 and 116, depending on the mode of operation (i.e., HEAT or COOL). In addition, check valves 84, 108, 112 and 118 guide flow in the correct direction when the system is switched from HEAT to COOL and from COOL to HEAT, as will be discussed further below.

In the COOL mode, liquid refrigerant flows from the outdoor unit 24 along conduit 70 generally towards the indoor unit 26, as previously discussed. In doing so, the flow is directed to the inlet 60 of flash tank 56 via conduit 111, whereby conduit 111 includes check valve 108 and capillary tube 110. It should be noted that the flow is further directed toward the flash tank 56, and restricted from reaching the indoor unit 26, by check valve 112. In this manner, the capillary tube 110 and check valves 108, 112, are operable to direct the liquid refrigerant from the outdoor unit 24 and into the flash tank 56 for vaporization and sub-cooling. In this regard, the overall flow of refrigerant is controlled by the capillary tubes 82, 116 and check valves 84, 108,112 and 118.

Once the refrigerant is vaporized and discharged to the scroll compressor 28, the sub-cooled-liquid refrigerant is discharged through port 64 and sent to the indoor unit 26 via a discharge conduit 114. Discharge conduit 114 is fluidly coupled to conduit 72 and includes capillary tube 116 and check valve 118. The check valve 118 is operable to direct the flow generally towards the indoor unit 26 and to prevent refrigerant from traveling towards the flash tank 56 along conduits 114 and 72, while the capillary tube 116 provides the indoor unit 26 with a partially expanded refrigerant stream for use in cooling the indoor space.

In the HEAT mode, the liquid refrigerant is received from the indoor unit 26 and is sent to the flash tank 56 via conduit 111 and check valve 112. In addition, capillary tube 120 is generally positioned between the indoor unit 26 and the flash tank 56 to partially expand the liquid refrigerant prior to entrance into the flash tank 56. In the HEAT mode, check valve 108 restricts refrigerant flow from the indoor unit 26 to the outdoor unit 24 and directs the flow into the flash tank 56. In this regard, the vapor injection system 32*b* is operable to control refrigerant flow throughout the system 22*b*. Once the refrigerant reaches the flash tank 56 and is sufficiently vaporized, the vapor is sent to the scroll compressor 28 and the sub-cooled-liquid refrigerant is sent to the outdoor unit 24 via conduits 72 and 70, as previously discussed.

Figure 4:
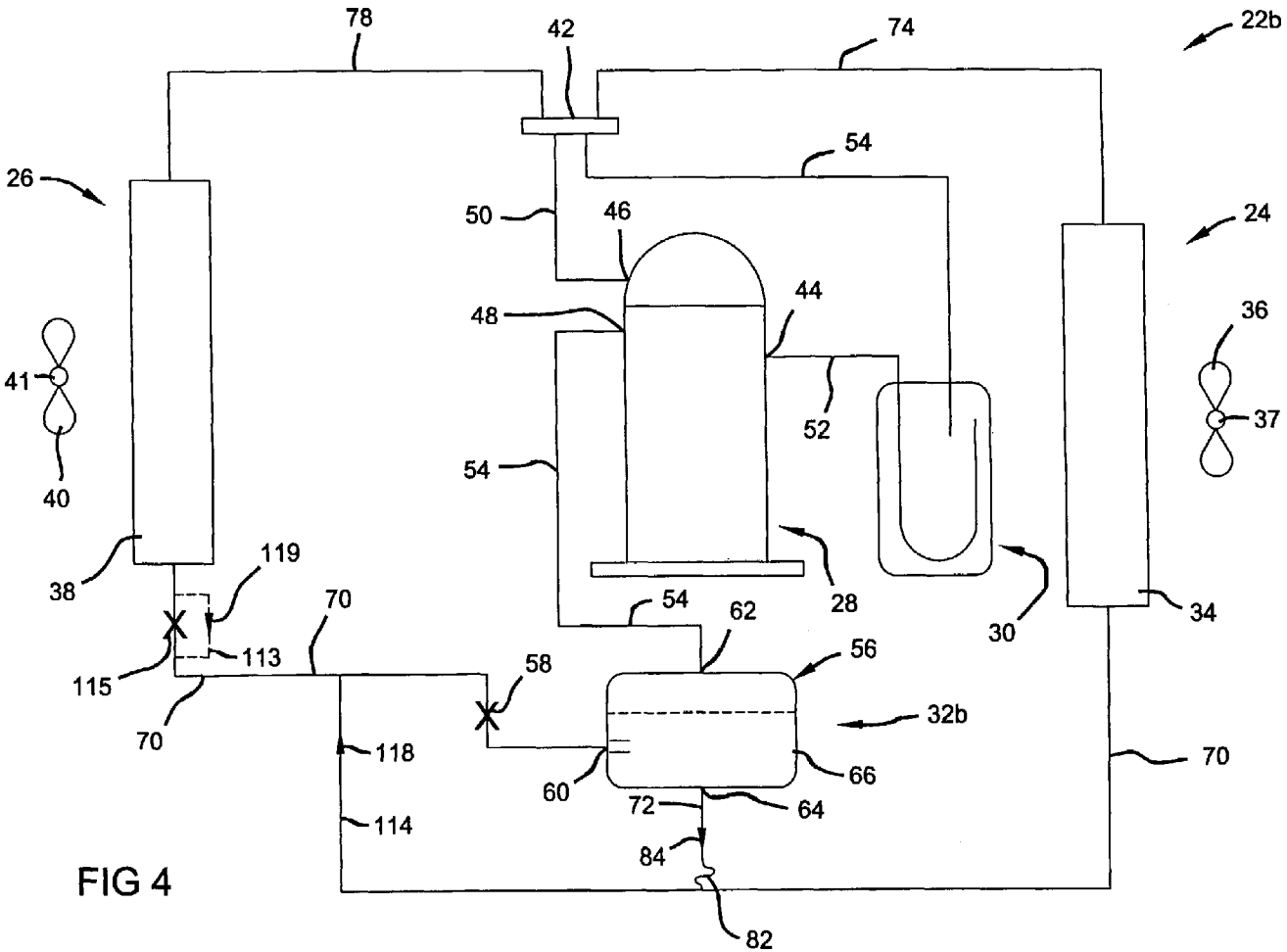
FIG. 4 is a schematic view of particular components of FIG. 3 depicting a vapor injection system used only during a HEATING cycle.

FIG. 4 depicts a "HEAT ONLY" condition, whereby refrigerant reaches the flash tank 56 when the four-way valve 42 is set to HEAT. In such a condition, liquid refrigerant is received by the flash tank 56 through inlet 60 via conduit 70 and solenoid valve 58. Specifically, solenoid valve 58 is set to an open position when the four-way valve 42 is set on the HEAT mode to allow fluid flow into the flash tank 56. In this manner, the solenoid valve 58, in response to the setting of the four-way valve 42 (i.e., HEAT mode versus COOL mode), selectively permits and restricts refrigerant flow into the flash tank 56. While a solenoid valve 58 is disclosed, it should be understood that any other suitable valve, such as an electronic expansion valve 107, is anticipated, and should be considered within the scope of the present invention.

When the four-way valve 42 is set to COOL, the refrigerant travels from the outdoor coil 34 along conduits 70, 114 prior to reaching the indoor coil 36. Conduit 114 is fluidly coupled to conduit 70 and includes check valve 118 to prevent flow along conduit 114 when the four-way valve 42 is set to HEAT. During the COOL mode, the solenoid valve 58 is in a closed position such that refrigerant is prevented from entering the vapor injection system 32*b*.

In addition, a bypass 113 having an expansion device 115 (such as a capillary tube) and a check valve 119 are also provided adjacent to indoor coil 38. While the expansion device 115 and check valve 119 are described as being adjacent to the indoor coil 38, it should be understood that they may alternatively be located in the outdoor unit 24. The expansion device 115 operates on COOL to expand the refrigerant prior to reaching the coil 38 and will be bypassed by the check valve 119 during HEAT.

Figure 5:
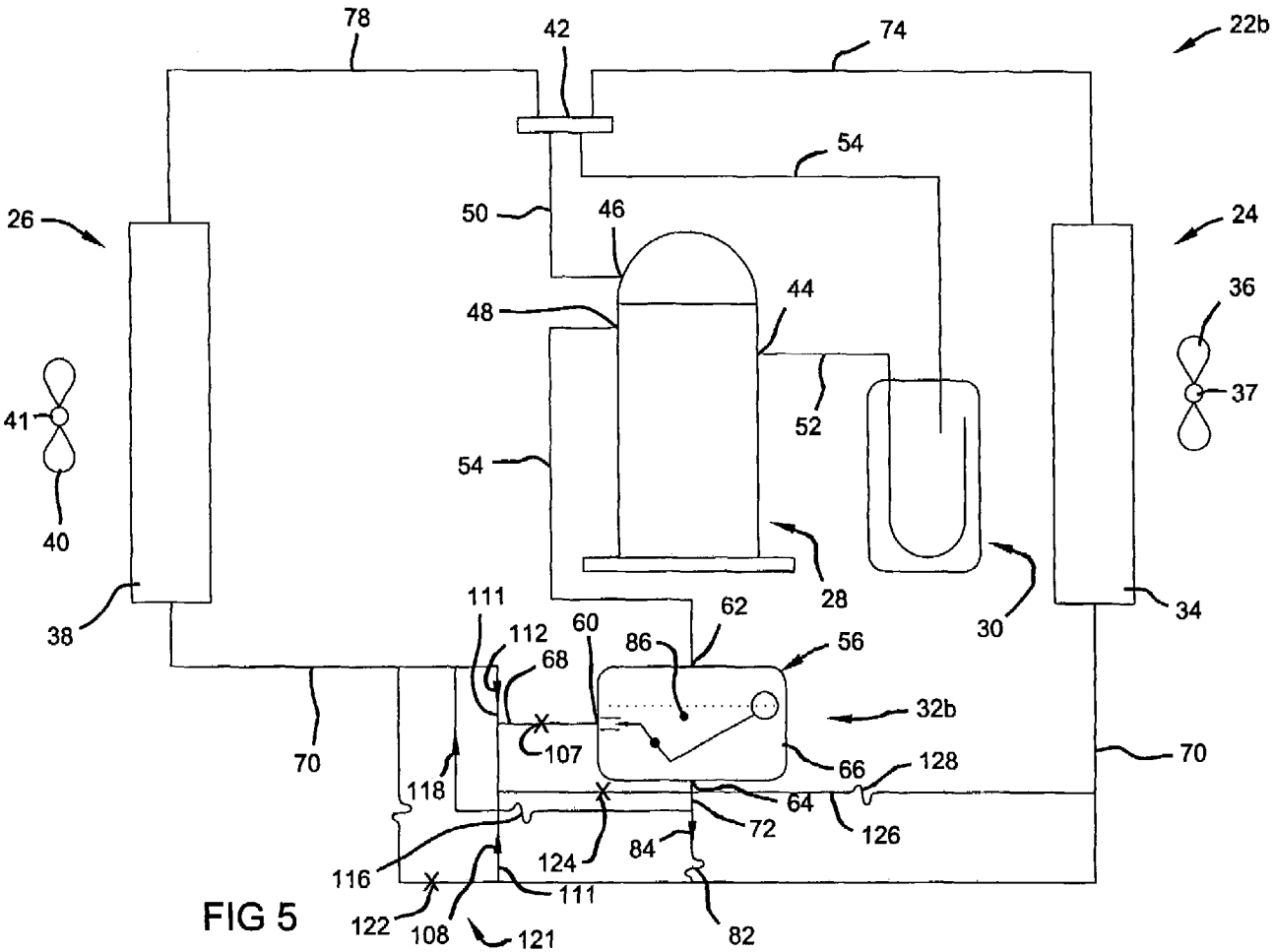
FIG. 5 is a schematic view of a heat pump system in accordance with the principles of the present invention.

With reference to FIG. 5, a heat pump system 22*b* is shown. In view of the similarity in structure and function of the components associated with the heat pump systems described above, like reference numerals are used hereinafter and in the drawings to identify like components while like reference numerals containing letter extensions are used to identify those components that have been modified.

The heat pump system 22*b* includes a control system operable to selectively permit and restrict refrigerant flow into the vapor injection system 32*b*. The control system includes a pair of solenoid valves 122, 124 operable to control refrigerant flow by selectively permitting and restricting flow through conduits 70, 111, as will be discussed further below.

In the COOL mode, liquid refrigerant is received from the outdoor unit 24 via conduit 70. The liquid refrigerant is directed to the flash tank 56 via conduit 111 and to the indoor unit 26 via conduit 70. Solenoid valve 122 is disposed between the outdoor and indoor units 24, 26 and is operable to restrict and permit refrigerant flow therebetween. Solenoid valve 124 is disposed between the outdoor unit 24 and the flash tank 56 and similarly serves to selectively restrict and permit refrigerant flow. In operation, when solenoid valve 122 restricts flow, refrigerant from the outdoor unit 24 is directed via conduit 111 into the flash tank 56 where it is vaporized and circulated as vapor back to the scroll compressor 28 and as sub-cooled refrigerant to the indoor unit 26. When solenoid valve 122 is open, refrigerant from the outdoor unit 24 is directed toward the indoor unit 26, thereby bypassing the vapor injection system 32*b*.

The control system is operable to selectively open and close valves 122, 124 depending on system conditions. Specifically, if more vaporized refrigerant is needed in the scroll compressor 28, solenoid valve 122 is closed, thereby directing more liquid refrigerant into the flash tank 56. On the other hand, if the system control so demands, the solenoid valve 107 is closed to restrict flow into the flash tank 56, thereby directing the liquid refrigerant from the outdoor unit 24 to the indoor unit 26 via conduit 70. In this manner, the solenoid valves 107, 122, 124 cooperate to cause the refrigerant to selectively bypass the vapor injection system 32*b* in response to system conditions and parameters. As can be appreciated, when the solenoid valve 107 restricts flow into the flash tank 56, the control system is operable to open solenoid valve 122 and permit flow to the indoor unit 26. In other words, the control system balances the flow of vaporized refrigerant to the scroll compressor 28, sub-cooled-liquid refrigerant to the indoor unit 26, and liquid refrigerant to the indoor unit 26 by selectively opening and closing solenoid valves 107, 122, 124.

In the HEAT mode, liquid refrigerant is received from the indoor unit 26 and flows to the flash tank 56 via conduit 111 and check valve 112. When the flash tank is not required for optimum capacity and efficiency, however, the control system is operable to restrict further flow into the tank 56 by closing solenoid valve 107. In such a situation, the refrigerant is directed toward the outdoor unit 24 via conduit 126. Conduit 126 includes a capillary tube 128 and fluidly couples conduit 111 and conduit 70 such that refrigerant may be directly sent from the indoor unit 26 to the outdoor unit 24 in a partially vaporized condition, as best shown in FIG. 5.

When the flash tank 56 requires further refrigerant, the control system is operable to close solenoid valve 124 disposed on conduit 126 in an effort to direct flow to the flash tank 56. In other words, the control system may restrict flow to the outdoor unit 24 by selectively closing solenoid valve 124 to direct flow from the indoor unit 26 to the flash tank 56 via conduit 111. In either of the foregoing situations, solenoid valve 122 is closed so as to direct flow either to conduit 111 or conduit 126, and therefore selectively allow and block flow in both directions (i.e., between the outdoor and indoor units 24, 26). While a solenoid valve 122 is disclosed, it should be understood that an electronic expansion valve (EXV) could be used in place of the solenoid valve 122, or could replace capillary tube 128 and solenoid valve 124, and is considered within the scope of the present invention.

In either of the foregoing HEAT and COOL modes, it should be understood that the vapor injection system 32*b* may be selectively bypassed such that the system 32*b* is only utilized under one of the HEATING or COOLING modes. More particularly, by closing solenoid valve 107 when the four-way valve 42 is set to HEAT, refrigeration cycling between the coils 34, 38 will bypass the vapor injection system 32*b* altogether. Similarly, by closing solenoid valve 107 when the four-way valve 42 is set to COOL, refrigeration cycling between the coils 34, 38 will bypass the vapor injection system 32*b*. In this manner, the vapor injection system 32*b* may be selectively used during either COOLING or HEATING, depending on the particular application and system requirements.

Figure 6:
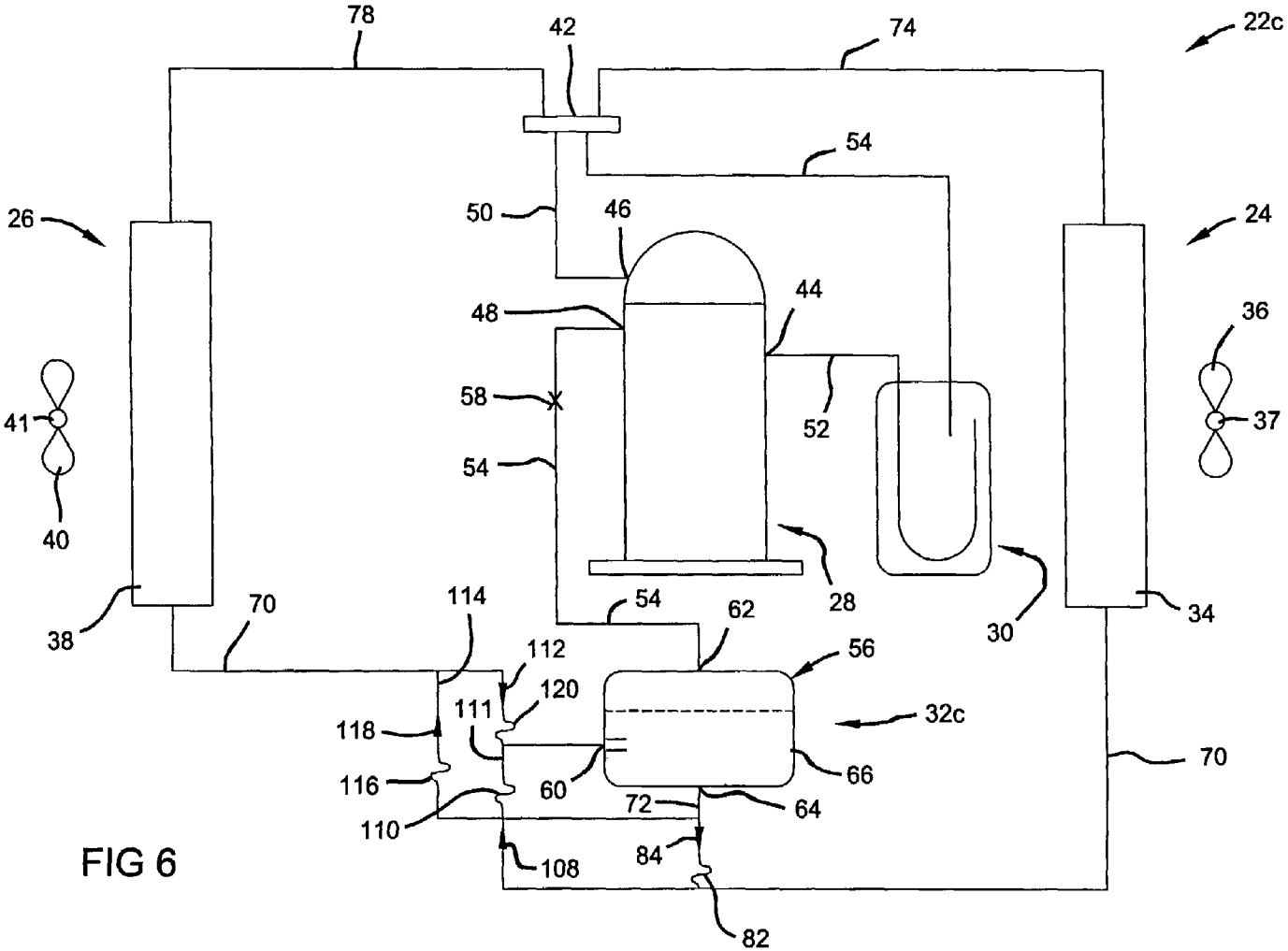
FIG. 6 is a schematic view of a heat pump system in accordance with the principals of the present invention.

With reference to FIG. 6, a heat pump system 22*c* is shown. In view of the similarity in structure and function of the components associated with the heat pump systems described above, like reference numerals are used hereinafter and in the drawings to identify like components while like reference numerals containing letter extensions are used to identify those components that have been modified.

Heat pump system 22*c* allows for vapor injection on both a HEAT and a COOL mode by adding an additional valve to control flow from vapor injection system 32*c* to the compressor 28. Specifically, a solenoid valve 58 is added to vapor line 54 such that vapor from the flash tank 56 is selectively restricted from reaching the compressor 28 through selective opening and closing of valve 58. Valve 58 controls vapor into the compressor 28 during each of the COOL and HEAT modes, and thus regulates a flow from the flash tank 56.

Figure 7:
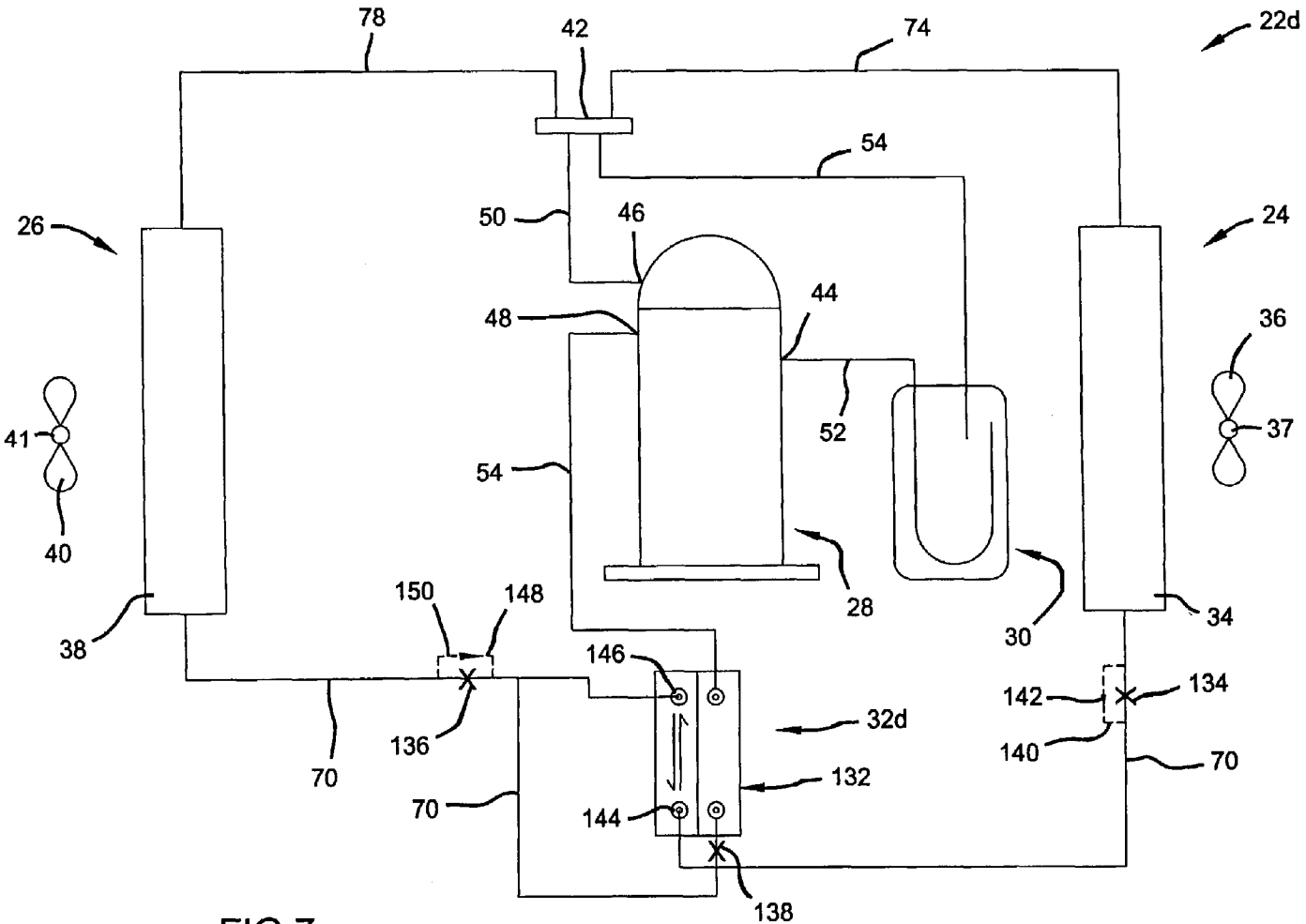
FIG. 7 is a schematic view of a heat pump system in accordance with the principles of the present invention.

With reference to FIG. 7, a heat pump system 22*d* is shown. In view of the similarity in structure and function of the components associated with the heat pump systems described above, like reference numerals are used hereinafter and in the drawings to identify like components while like reference numerals containing letter extensions are used to identify those components that have been modified.

The heat pump system 22*d* includes a vapor injection system 32*d* having a plate heat exchanger 132 and a series of control valves 134, 136, 138. The plate heat exchanger 132 is operable to vaporize liquid refrigerant and to distribute such vaporized refrigerant to the scroll compressor 28 to improve the overall efficiency of the compressor 28 and heat pump system 22*d*. The control valves 134, 136, 138 serve to control liquid refrigerant into the plate heat exchanger 132, thereby controlling refrigerant flow through the system 22*d*, as will be discussed further below.

The first control valve 134 is disposed proximate an outlet of the outdoor coil 34 and may selectively restrict flow into the coil 34, as will be described further below. In addition, a bypass 140 and check valve 142 are provided to allow flow from the outdoor unit 24 regardless of the position of control valve 134 (i.e., open or closed). In the COOL mode, the first control valve 134 is in the closed position such that liquid flows to the vapor injection system 32*d* via bypass 140 and check valve 142. The refrigerant is then received by the vapor injection system 32*d* at an inlet 144 of the plate heat exchanger 132 and discharged at an outlet 146. Once the refrigerant is discharged, the refrigerant passes through the second control valve 136 prior to reaching the indoor unit 26. While the expansion devices 134 and 136 are shown adjacent to the outdoor and indoor heat exchangers 34, 38, expansion devices 134, 136 may be located in any position between the plate heat exchanger 132 and the respective heat exchangers 26 and 24. Expansion devices with built-in check valves may obviate the need for check valves 142 and 150 and may also be used with the invention.

In the HEAT mode, control valve 136 is closed to restrict refrigerant from flowing from the indoor unit 26 to the vapor injection system 32*d*. A bypass 148 and check valve 150 allow refrigerant to reach the plate heat exchanger 132 when the control valve 136 is closed. After the refrigerant passes through the bypass 148 and check valve 150, the refrigerant encounters control valve 138 prior to reaching the plate heat exchanger 132. Control valve 138 is an electronic expansion valve and is operable to selectively meter the amount of liquid refrigerant reaching the plate heat exchanger 132 and, thus, the amount of vaporized refrigerant reaching the scroll compressor 28. If the scroll compressor 28 requires a significant amount of vaporized refrigerant, valve 138 may be opened fully, thereby maximizing an amount of liquid refrigerant passing though the plate heat exchanger 132. The more liquid refrigerant heated by plate 132, the more vapor that will be produced. In this regard, control valve 138 may serve not only to meter the amount of liquid entering the plate heat exchanger 132, but may meter the amount of vapor reaching the scroll compressor 28.

It should be noted that control valves 134, 136 cooperate with control valve 138 to regulate refrigerant flow within the system 22*d*. In this regard, the valves 134, 136, 138 can be selectively opened and closed to distribute refrigerant to the vapor injection system 32*d*, scroll compressor 28, and heat exchangers 34, 38 to properly balance the system 22*d* and optimize capacity and efficiency. In addition, valves 134 and 136 may alternatively be replaced by fixed restrictive expansion devices and, as such, should be considered within the scope of the present teachings.

Valve 138 is operable to selectively restrict refrigerant from reaching the heat plate exchanger 132, as previously discussed. When valve 138 is closed, refrigerant bypasses the vapor injection system 32*d* by traveling between the inlet 144 and outlet 146 of heat plate 132, as indicated by directional arrows in FIG. 7. In this manner, the system 22*d* may be tailored such that the vapor injection system 32*d* is only utilized under one of the HEAT mode or the COOL mode. If the vapor injection system 32*d* is only used during the HEAT mode, valve 138 will be closed during the COOL mode to restrict refrigerant from entering the heat plate exchanger 132. Similarly, if the vapor injection system 32*d* is only used during the COOL mode, valve 138 will be closed during the HEAT mode to restrict refrigerant from entering the heat plate exchanger 132. In this manner, the vapor injection system 32*d* may be selectively used during either COOLING or HEATING, depending on the particular application and system requirements.

Figure 8:
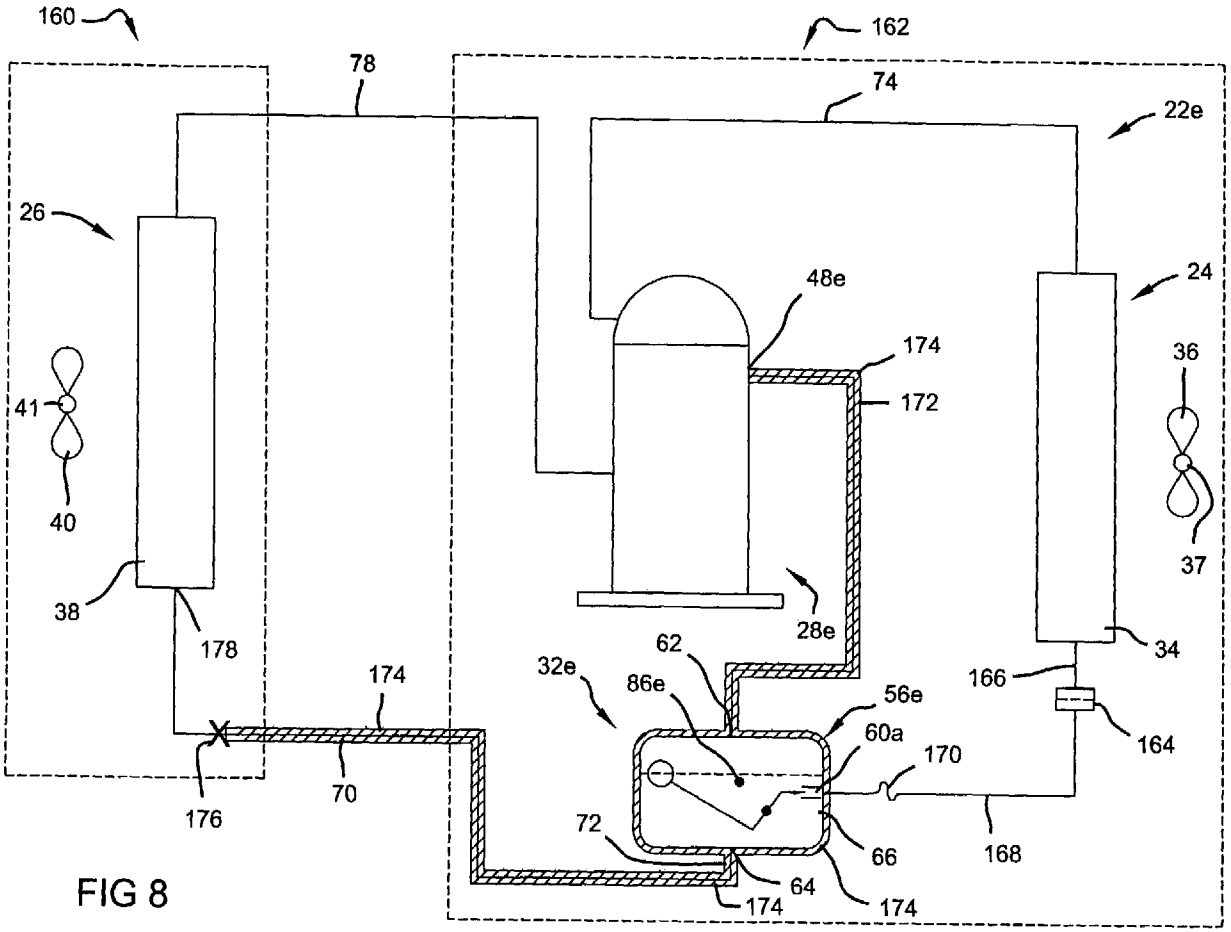
FIG. 8 is a schematic view of a refrigeration system in accordance with the principles of the present invention.

With reference to FIG. 8, a cooling system 22*e* is shown. In view of the similarity in structure and function of the components associated with the heat pump systems described above, like reference numerals are used hereinafter and in the drawings to identify like components while like reference numerals containing letter extensions are used to identify those components that have been modified.

The cooling system 22*e* is generally used for refrigerating or cooling an interior space. The cooling system 22*e* may be incorporated into a chiller, refrigeration or air-conditioning system to cool an interior space. As shown in FIG. 8, the cooling system 22*e* is incorporated into a refrigerator 160, whereby the indoor unit 26 is disposed therein and the outdoor unit 24 is disposed external to the refrigerator 160 and is more commonly referred to as the condensing unit 162. Monobloc construction is also possible where the outdoor and indoor units 24, 26 are constructed in the same frame and the working principle is similar. While a refrigerator 160 is disclosed, it should be understood that the cooling system 22*e* could be used in other cooling devices such as a refrigerated display case, freezer, chiller, or air-conditioning system, each of which is considered within the scope of the present invention.

The condensing unit 162 includes the outdoor coil 34, an expansion device 32*e*, and a compressor 28*e*. A receiver 164 may also be included, in which case it may be fluidly coupled to an outlet 166 of coil 34 and is operable to receive and store fluid refrigerant from the coil 34 for use in the expansion device 32*e*, as will be discussed further below. The flash tank 56*e* and receiver 164 may also be combined into a single component.

The expansion device 32*e* is fluidly coupled to the receiver 164 via conduit 168 such that liquid refrigerant flows between the receiver 164 and expansion device 32*e* along conduit 168. In addition, a capillary tube 170 may be disposed proximate to an inlet 60*a* of the expansion device 32*e* and may partially expand the refrigerant prior to entering the expansion device 32*e*.

The expansion device 32*e* includes a flash tank 56*e* and a float device 86*e* and is operable to vaporize refrigerant from the outdoor coil 34 for use by the compressor 28*e* and to concurrently produce a sub-cooled-liquid refrigerant for use by the indoor coil 38. The flash tank 56*e* is fluidly coupled to the outdoor coil 34 via conduit 168 and fluidly coupled to the indoor coil 38 via conduit 72 and exit port 64. In addition, the flash tank 56*e* is fluidly coupled to the compressor 28*e* via outlet port 62 and conduit 172. Conduit 172 is fluidly coupled to the compressor 28*e* at a vapor injection port 48*e* and is operable to deliver the pressurized-vapor refrigerant to the compressor 28*e*. As previously discussed with regard to FIGS. 1-7, an increase in system efficiency and capacity may be realized by delivering a stream of pressurized-vapor to the vapor injection port 48*e* of the compressor 28*e*.

The expansion device 32*e* may include float device 86*e* for use in metering refrigerant into the interior space 66 of the flash tank 56*e*. The float device 86*e* is operable to react to an amount of liquid refrigerant disposed within the flash tank 56*e* and to selectively permit more refrigerant into the tank 56 when a predetermined lower limit is realized. As the float device 86*e* has been sufficiently described with respect to FIGS. 1-7, a detailed description of its structure and function is foregone. It should be noted, however, that the float device 86*e* has been modified to accommodate the inlet 60*a*. More particularly, the inlet 60*a* has been moved so as to receive liquid refrigerant from the outdoor coil 34 at an opposite location to that of inlet 60 in the previous embodiments.

In addition, the expansion device 32*e* may include insulation 174 generally surrounding the flash tank 56*e* and conduits 70, 72, and 172. The insulation 174 ensures the sub-cooled-liquid refrigerant maintains its state when traveling between the flash tank 56*e* and indoor unit 26 along conduits 70 and 72. Similarly, the insulation 174 ensures that the vaporized refrigerant maintains its state when traveling from the flash tank 56*e* to the compressor 28*e*. As can be appreciated, more insulation 174 may be required depending on the relative distances between the flash tank 56*e* and the indoor unit 26 and compressor 28*e*.

While insulation has been described and shown in relation to cooling system 22*e*, it should be noted that insulation 174 can be provided for any of the foregoing heat pump systems. More particularly, the greater the distance between the respective components, the more likely it will be that the refrigerant will change phase prior to reaching the indoor unit 26 and compressor 28, respectively.

An expansion device 176 may be disposed proximate to an inlet 178 of the indoor unit 26 and may partially expand the sub-cooled-liquid refrigerant prior to reaching the indoor coil 38. The expansion device 176 may be an electronically-controlled expansion device (EXV), a thermally-controlled expansion device (TXV), a capillary tube or an evaporator pressure regulator. It should be noted that if an evaporator pressure regulator is used, an EXV may also be used in conjunction therewith to further control refrigerant flow into the indoor unit 26.

With particular reference to FIG. 8, the operation of the cooling system 22*e* will be described in detail. When liquid refrigerant exits outlet 166 of the outdoor unit 24, it enters the receiver 164, if included, and may be stored there for use by the expansion device 32*e*. When the expansion device 32*e* requires liquid refrigerant, refrigerant may be drawn from the receiver 164 and into the flash tank 56*e* for use in producing both pressurized-vapor refrigerant and sub-cooled-liquid refrigerant.

As the liquid refrigerant travels along conduit 168, the capillary tube 170 serves to partially expand the fluid prior to entering the flash tank 56*e*. Once in the flash tank 56*e*, the refrigerant releases heat, thereby concurrently producing both a pressurized-vapor refrigerant and a sub-cooled-liquid refrigerant, as previously discussed. The pressurized-vapor refrigerant it directed toward the vapor injection port 48*e* of the compressor 28*e* while the sub-cooled-liquid refrigerant is directed toward the indoor unit 26 via conduits 72, 70 and expansion device 176.

After the pressurized-vapor refrigerant has been sufficiently compressed by the compressor 28*e*, the fluid may be directed to the outdoor unit 24 via conduit 74. The sub-cooled-liquid refrigerant is expanded by the expansion device 176 and absorbs heat from an interior space of the refrigerator 160. As can be appreciated, by absorbing heat from the refrigerator 160, the interior space is cooled and the refrigerant is vaporized. After the refrigerant is vaporized, it exits the indoor unit 26 and returns to the compressor 26*e* via conduit 78 for compression. The compressed refrigerant is mixed with the pressurized-vapor refrigerant from the flash tank 56*e* and is then sent to the outdoor unit 24 to begin the process anew.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A heat pump system comprising:

a first heat exchanger;

a second heat exchanger in fluid communication with said first heat exchanger;

a scroll compressor in fluid communication with each of said first and second heat exchangers; and a flash tank in fluid communication with each of said first and second heat exchangers and said scroll compressor, said flash tank including:

an inlet fluidly coupled to said first and second heat exchangers and operable to receive liquid refrigerant from said first and second heat exchangers;

a first outlet fluidly coupled to said first and second heat exchangers, said first outlet operable to deliver sub-cooled-liquid refrigerant to said first and second heat exchangers;

a second outlet fluidly coupled to said scroll compressor, said second outlet operable to deliver vaporized refrigerant to said scroll compressor; and an expansion valve operable to selectively open and close said inlet by a float device, said float device operable to control an amount of liquid refrigerant disposed within said flash tank by regulating an amount of liquid refrigerant entering said flash tank via said inlet.

2. The heat pump of claim 1, wherein said float device includes a buoyant member fixedly attached to an outwardly extending arm, said buoyant member operable to float in said flash tank and actuate said arm in response to fluid level changes.

3. The heat pump of claim 2, wherein said float device further comprises an expansion needle, said expansion needle operably attached to said outwardly extending arm and movable between a fully open position and a fully closed position.

4. The heat pump of claim 3, wherein said needle includes a tapered surface, said tapered surface selectively received by said inlet to prohibit flow into said flash tank in said fully closed position and disengaging said inlet to define a plurality of open positions in response to movement of said outwardly extending arm.

5. The heat pump of claim 3, further comprising a needle housing, said needle housing pivotably supporting said outwardly extending arm and slidably supporting said expansion needle.

6. The heat pump of claim 1, wherein said scroll compressor includes a vapor injection port, said vapor injection port in fluid communication with said second outlet of said flash tank.

7. The heat pump of claim 1, further comprising a four-way valve disposed at an outlet of said scroll compressor, said four-way valve operable to direct refrigerant flow between said first and second heat exchangers to selectively toggle the heat pump between heating and cooling functions.

8. The heat pump of claim 7, further comprising a solenoid valve disposed proximate said inlet to selectively restrict fluid flow into said flash tank, said solenoid valve in a closed position when said four-way valve is in said heating function.

9. In a heat pump system of the type which re-circulates refrigerant through a fluid circuit between a first heat exchanger and a second heat exchanger including a scroll compressor coupled to the fluid circuit, a vapor injection system comprising:

a tank fluidly coupled to the first and second heat exchangers and the scroll compressor;

an inlet fluidly coupling said first and second heat exchangers and said tank, said inlet operable to receive liquid refrigerant from said first and second heat exchangers;

a first outlet fluidly coupling said first and second heat exchangers and said tank, said first outlet operable to deliver sub-cooled-liquid refrigerant to said first and second heat exchangers;

a second outlet fluidly coupling said scroll compressor and said tank, said second outlet operable to deliver vaporized refrigerant to said scroll compressor; and an expansion valve operable to selectively open and close said inlet by a float device, said float device operable to control an amount of liquid refrigerant disposed within said tank by regulating an amount of liquid refrigerant entering said tank via said inlet.

10. The vapor injection system of claim 9, wherein said vapor injection includes a buoyant member fixedly attached to an outwardly extending arm, said buoyant member operable to float in said tank and actuate said arm in response to fluid level changes in said tank.

11. The vapor injection system of claim 10, wherein said float device further comprises an expansion needle, said expansion needle operably attached to said outwardly extending arm and movable between a fully open position and a fully closed position in response to fluid level changes within said tank.

12. The vapor injection system of claim 11, wherein said needle includes a tapered surface, said tapered surface selectively received by said inlet to prohibit flow into said tank in said fully closed position and disengaging said inlet to define a plurality of open positions in response to movement of said outwardly extending arm.

13. The vapor injection system of claim 11, further comprising a needle housing, said needle housing pivotably supporting said outwardly extending arm and slidably supporting said expansion needle.

14. The vapor injection system of claim 9, further comprising a control valve disposed adjacent said inlet, said control valve operable to selectively restrict flow into said tank in a closed position and permit flow into said tank in an open position.

15. The vapor injection system of claim 14, wherein said control valve is a solenoid valve.

16. The vapor injection system of claim 14, further comprising a first bypass conduit, said first bypass conduit operable to allow flow between the first and second heat exchangers in a first direction when said control valve is in either of said open or closed positions.

17. The vapor injection system of claim 16, wherein said bypass conduit comprises at least one capillary tube.

18. The vapor injection system of claim 16, wherein said bypass conduit comprises at least one check valve to permit fluid flow in said first direction between the first and second heat exchangers and restrict fluid flow in a second direction between the first and second heat exchangers.

19. The vapor injection system of claim 14, further comprising a second bypass conduit, said second bypass conduit operable to allow flow between the first and second heat exchangers in a second direction when said control valve is in either of said open or closed positions.

20. The vapor injection system of claim 19, wherein said bypass conduit comprises at least one capillary tube.

21. The vapor injection system of claim 19, wherein said bypass conduit comprises at least one check valve to permit fluid flow in said second direction between the first and second heat exchangers and restrict fluid flow in a first direction between the first and second heat exchangers.

22. The vapor injection system of claim 9, further comprising a check valve disposed between the first heat exchanger and said tank, said check valve operable to permit flow from the first heat exchanger to said tank and restrict flow from the second heat exchanger to the first heat exchanger.

23. The vapor injection system of claim 9, further comprising a check valve disposed between the second heat exchanger and said tank, said check valve operable to permit flow from the second heat exchanger to said tank and restrict flow from the first heat exchanger to the second heat exchanger.

24. The vapor injection system of claim 9, further comprising a capillary tube disposed adjacent said first outlet, said capillary tube operable to vaporize said sub-cooled-liquid refrigerant from said first outlet prior to said sub-cooled-liquid refrigerant reaching said first and second heat exchangers.

25. The vapor injection system of claim 9, wherein the scroll compressor includes a vapor injection port, said vapor injection port in fluid communication with said second outlet of said tank.

26. A heat pump comprising:

a first heat exchanger;

a second heat exchanger in fluid communication with said first heat exchanger;

a scroll compressor in fluid communication with each of said first and second heat exchangers, said scroll compressor including a vapor injection port;

a flash tank in fluid communication with each of said first and second heat exchangers and said scroll compressor;

a valve in fluid communication with said flash tank and operable to selectively permit and restrict flow from said first and second heat exchangers into said flash tank; and a vapor-injection valve disposed between said flash tank and said scroll compressor and operable to control an amount of vaporized refrigerant received by said vapor injection port from said flash tank.

27. The heat pump of claim 26, further comprising a first check valve operable to permit flow from said first heat exchanger into said flash tank and prevent flow from said second heat exchanger into said flash tank.

28. The heat pump of claim 26, further comprising a second check valve operable to permit flow from said second heat exchanger into said flash tank and prevent flow from said first heat exchanger into said flash tank.

29. The heat pump of claim 26, further comprising an outlet conduit in fluid communication with said flash tank, said outlet operable to transfer a sub-cooled-liquid refrigerant from said flash tank to said first and second heat exchangers.

30. The heat pump of claim 29, further comprising a third check valve, said third check valve permitting a flow from said flash tank to said first and second heat exchangers and preventing a flow from said first and second heat exchangers to said flash tank.

31. The heat pump of claim 29, wherein said outlet conduit further comprises at least one capillary tube, said at least one capillary tube operable to expand said sub-cooled-liquid refrigerant prior to said refrigerant reaching said first and second heat exchangers.

32. The heat pump of claim 26, wherein said valve is an expansion valve, said expansion valve operable to meter refrigerant flow into said expansion device.

33. The heat pump of claim 26, wherein said valve is a solenoid valve, said solenoid valve moveable between an open position allowing flow into said expansion device and a closed position restricting flow into said expansion device.

34. A heat pump operable in a heating mode and in a cooling mode, the heat pump comprising:

a first heat exchanger;

a second heat exchanger in fluid communication with said first heat exchanger;

a scroll compressor in fluid communication with each of said first and second heat exchangers, said scroll compressor including a vapor injection port;

a flash tank in fluid communication with each of said first and second heat exchangers and said scroll compressor;

a check valve arrangement operable to permit flow from at least one of said first and second heat exchangers into said flash tank and prevent flow from the other of said first and second heat exchangers into said flash tank to control an amount of vaporized refrigerant received by said vapor injection port by regulating an amount of liquid refrigerant entering said flash tank.

35. The heat pump of claim 34, wherein said check valve arrangement includes a first and second check valve operable to permit flow from said second heat exchanger into said flash tank and prevent flow from said first heat exchanger into said flash tank.

36. The heat pump of claim 34, further comprising a capillary tube disposed between said first check valve and said flash tank, said capillary tube operable to expand said liquid refrigerant prior to reaching said flash tank.

37. The heat pump of claim 34, further comprising a capillary tube disposed between said second check valve and said flash tank, said capillary tube operable to expand said liquid refrigerant prior to reaching said flash tank.

38. The heat pump of claim 34, comprising an outlet conduit in fluid communication with said flash tank, said outlet operable to transfer a sub-cooled-liquid refrigerant from said flash tank to said first and second heat exchangers.

39. The heat pump of claim 38, further comprising a third check valve, said third check valve permitting a flow from said flash tank to said first and second heat exchangers and preventing a flow from said first and second heat exchangers to said flash tank.

40. The heat pump of claim 38, wherein said outlet conduit further comprises at least one capillary tube, said at least one capillary tube operable to expand said sub-cooled-liquid refrigerant prior to said refrigerant reaching said first and second heat exchangers.

41. The heat pump of claim 34, further comprising bypass conduit in fluid communication with said outlet conduit, said bypass conduit operable to permit flow from said flash tank to one of said first and second heat exchangers.

42. The heat pump of claim 41, wherein said bypass conduit includes a check valve, said check valve operable to permit flow from said flash tank to one of said first and second heat exchangers and restrict flow from one of first and second heat exchangers to said flash tank.

43. The heat pump of claim 41, wherein said bypass conduit includes a capillary tube, said capillary tube operable to expand said sub-cooled-liquid refrigerant prior to reaching one of said first and second heat exchangers.

44. The heat pump of claim 34, wherein said check valve arrangement includes a check valve, said check valve operable to permit refrigerant into said flash tank in the cooling mode and restrict refrigerant into said flash tank in the heating mode.

45. The heat pump of claim 34, wherein said check valve arrangement includes a check valve, said check valve operable to permit refrigerant into said flash tank in the heating mode and restrict refrigerant into said flash tank in the cooling mode.

46. A heat pump comprising:

a first heat exchanger;

a second heat exchanger in fluid communication with said first heat exchanger;

a scroll compressor in fluid communication with each of said first and second heat exchangers, said scroll compressor including a vapor injection port;

a plate heat exchanger in fluid communication with each of said first and second heat exchangers and said scroll compressor; and a first valve disposed adjacent an inlet of said plate heat exchanger, said first valve operable between an open position and a closed position to control a flow of refrigerant into said plate heat exchanger to control an amount of vaporized refrigerant received by said vapor injection port by regulating an amount of liquid refrigerant entering said plate heat exchanger.

47. The heat pump of claim 46, further comprising a second valve disposed between said first heat exchanger and said plate heat exchanger, said second valve operable between an open position and a closed position to control flow between said first heat exchanger and said second heat exchanger.

48. The heat pump of claim 47, further comprising a bypass conduit, said bypass conduit permitting flow between said first heat exchanger and said second heat exchanger when said second valve is in said closed position.

49. The heat pump of claim 48, further comprising a first check valve disposed on said bypass conduit, said first check valve operable to permit flow from said first heat exchanger to said second heat exchanger and restrict flow from said second heat exchanger to said first heat exchanger.

50. The heat pump of claim 46, further comprising a third valve disposed between said second heat exchanger and said plate heat exchanger, said third valve operable to control flow between said second heat exchanger and said first heat exchanger.

51. The heat pump of claim 50, further comprising a bypass conduit, said bypass conduit permitting flow between said second heat exchanger and said first heat exchanger when said third valve is in said closed position.

52. The heat pump of claim 51, further comprising a second check valve disposed on said bypass conduit, said second check valve operable to permit flow from said second heat exchanger to said first heat exchanger and restrict flow from said first heat exchanger to said second heat exchanger.

53. The heat pump of claim 46, wherein an outlet of said plate heat exchanger is in fluid communication with said vapor injection port of said scroll compressor.

54. The heat pump of claim 46, wherein said first valve is a solenoid valve.

55. The heat pump of claim 46, wherein said first valve is an expansion valve.

56. A heat pump comprising:

a first heat exchanger;

a second heat exchanger in fluid communication with said first heat exchanger;

a scroll compressor in fluid communication with each of said first and second heat exchangers, said scroll compressor including a vapor injection port;

a vapor injection apparatus in fluid communication with each of said first and second heat exchangers and said scroll compressor; and a first valve in fluid communication with said vapor injection apparatus and operable to selectively permit and restrict flow from said first and second heat exchangers into said vapor injection apparatus;

a second valve disposed proximate to an outlet of said vapor injection apparatus and operable to selectively permit and restrict flow from said vapor injection apparatus to said first and second heat exchangers, said second valve cooperating with said first valve to control an amount of vaporized refrigerant received by said vapor injection port by regulating an amount of liquid refrigerant entering and exiting said vapor injection apparatus.

57. The heat pump of claim 56, wherein said vapor injection apparatus is a flash tank.

58. The heat pump of claim 56, wherein said vapor injection apparatus is a plate heat exchanger.

59. The heat pump of claim 56, wherein said valve is a solenoid valve.

60. The heat pump of claim 56, wherein said valve is an expansion valve.

61. The heat pump of claim 56, further comprising a first check valve operable to permit flow from said first heat exchanger into said vapor injection apparatus and prevent flow from said second heat exchanger into said vapor injection apparatus.

62. The heat pump of claim 56, further comprising a second check valve operable to permit flow from said second heat exchanger into said vapor injection apparatus and prevent flow from said first heat exchanger into said vapor injection apparatus.

63. The heat pump of claim 56, further comprising an outlet conduit in fluid communication with said vapor injection apparatus, said outlet operable to transfer a sub-cooled-liquid refrigerant from said vapor injection apparatus to said first and second heat exchangers.

64. The heat pump of claim 56, further comprising a third check valve, said third check valve permitting a flow from said vapor injection apparatus to said first and second heat exchangers and preventing a flow from said first and second heat exchangers to said vapor injection apparatus.

65. The heat pump of claim 64, wherein said outlet conduit further comprises at least one capillary tube, said at least one capillary tube operable to expand said sub-cooled-liquid refrigerant prior to said refrigerant reaching said first and second heat exchangers.

* * * * *